US009272504B2

(12) United States Patent
Bangel

(10) Patent No.: US 9,272,504 B2
(45) Date of Patent: Mar. 1, 2016

(54) FLEXOGRAPHIC PRINTING UNIT WITH KNEE LEVER SYSTEM AND NARROW WEB LABEL PRINTING PRESS HAVING AT LEAST ONE FLEXOGRAPHIC PRINTING UNIT

(71) Applicant: GALLUS DRUCKMASCHINEN GMBH, Langgoens-Oberkleen (DE)

(72) Inventor: Dieter Bangel, Huettenberg (DE)

(73) Assignee: Gallus Druckmaschinen GmbH, Langgoens-Oberkleen (DE)

( * ) Notice: Subject to any disclaimer, the term of this patent is extended or adjusted under 35 U.S.C. 154(b) by 10 days.

(21) Appl. No.: 14/169,309

(22) Filed: Jan. 31, 2014

(65) Prior Publication Data

US 2014/0144338 A1 May 29, 2014

Related U.S. Application Data

(63) Continuation of application No. PCT/EP2012/003908, filed on Sep. 19, 2012.

(30) Foreign Application Priority Data

Nov. 22, 2011 (DE) ..... 10 2011 119 088

(51) Int. Cl.

| | |
|---|---|
| ***B41F 13/26*** | (2006.01) |
| ***B41F 5/24*** | (2006.01) |
| ***B41F 13/30*** | (2006.01) |
| ***B41F 13/44*** | (2006.01) |

(Continued)

(52) U.S. Cl.

CPC . *B41F 13/26* (2013.01); *B41F 5/24* (2013.01); *B41F 13/085* (2013.01); *B41F 13/30* (2013.01); *B41F 13/44* (2013.01); *B41F 33/02* (2013.01); *Y10T 29/49826* (2015.01)

(58) Field of Classification Search

CPC ..... B41F 13/26; B41F 13/30; B41F 13/44; B41F 5/24; B41P 2200/12

See application file for complete search history.

(56) References Cited

U.S. PATENT DOCUMENTS

| | | | |
|---|---|---|---|
| 4,384,522 | A | 5/1983 | Ehlers et al. |
| 5,697,297 | A | 12/1997 | Rasmussen |

(Continued)

FOREIGN PATENT DOCUMENTS

| | | | |
|---|---|---|---|
| CN | 101396900 | A | 4/2009 |
| DE | 19513536 | A1 | 10/1996 |

(Continued)

OTHER PUBLICATIONS

International Search Report of PCT/EP2012/003908, Dated December 3, 2012.

*Primary Examiner* — Daniel J Colilla
*Assistant Examiner* — Leo T Hinze
(74) *Attorney, Agent, or Firm* — Laurence A. Greenberg; Werner H. Stemer; Ralph E. Locher

(57) ABSTRACT

A flexographic printing unit includes an engraved roll, a form cylinder and an impression cylinder. Axes of rotation of the engraved roll and the form cylinder are disposed in a horizontal plane and axes of rotation of the form cylinder and the impression cylinder are disposed in a vertical plane. The printing unit has at least one knee lever system for applying a pretensioning force to the form cylinder. A narrow web label printing press having at least one flexographic printing unit is also provided.

13 Claims, 3 Drawing Sheets

(51) Int. Cl.
*B41F 33/02* (2006.01)
*B41F 13/08* (2006.01)

(56) References Cited

U.S. PATENT DOCUMENTS

| | | | | |
|---|---|---|---|---|
| 6,019,046 | A | 2/2000 | Rodi | |
| 6,422,143 | B1 * | 7/2002 | Lawrence et al. | 101/216 |
| 7,096,783 | B2 * | 8/2006 | Schrauwers | 101/216 |
| 7,398,730 | B2 * | 7/2008 | Schrauwers | 101/216 |
| 8,505,450 | B2 | 8/2013 | Bangel et al. | |
| 2006/0150837 | A1 | 7/2006 | Thimm et al. | |
| 2006/0156934 | A1 | 7/2006 | Arabin et al. | |

FOREIGN PATENT DOCUMENTS

| | | | |
|---|---|---|---|
| DE | 102007028327 | A1 | 12/2008 |
| DE | 102007045876 | A1 | 4/2009 |
| DE | 10343411 | B4 | 7/2009 |
| EP | 2042315 | A2 | 4/2009 |
| WO | 9529813 | A1 | 11/1995 |
| WO | 2004062915 | A1 | 7/2004 |

* cited by examiner

FLEXOGRAPHIC PRINTING UNIT WITH KNEE LEVER SYSTEM AND NARROW WEB LABEL PRINTING PRESS HAVING AT LEAST ONE FLEXOGRAPHIC PRINTING UNIT

CROSS-REFERENCE TO RELATED APPLICATION

This is a continuation, under 35 U.S.C. §120, of copending International Application No. PCT/EP2012/003908, filed Sep. 19, 2012, which designated the United States; this application also claims the priority, under 35 U.S.C. §119, of German Patent Application DE 10 2011 119 088.4, filed Nov. 22, 2011; the prior applications are herewith incorporated by reference in their entirety.

BACKGROUND OF THE INVENTION

Field of the Invention

The invention relates to a flexographic printing unit including an engraved roll, a form cylinder and an impression cylinder, in which form cylinders of different diameters can be used. The invention also relates to a narrow web label printing press having at least one such flexographic printing unit.

In printing presses for printing labels and folding boxes, great flexibility or variability is desired to an increasing extent, in order for it to be possible to carry out as many different types of print jobs as possible, in particular while producing special visual effects by way of the printed image or the printed text. In order to produce labels and folding boxes, printing presses are used particularly frequently which process a narrow web of a printing material and have a number of connecting platforms or interfaces, at which in each case one functional unit or one process module for printing by way of a defined printing process can be releasably received. For example, one embodiment of a printing press of that type is described in U.S. Pat. No. 4,384,522. There, the individual functional units can operate by using printing processes which differ from one another.

German Patent Application DE 195 13 536 A1, corresponding to U.S. Pat. No. 6,019,046, and International Publication No. WO 95/29813, corresponding to U.S. Pat. No. 5,697,297, have disclosed printing presses having a plurality of printing units in an inline configuration, which permit the releasable receiving of a number of functional units or process modules on a number of connecting platforms. The functional units can include, inter alia, printing units or parts of printing units in cassettes or attachments which operate according to a letterpress printing process, a flexographic printing process, a screen printing process, an offset printing process, a gravure printing process or an inkjet printing process. Moreover, functional units (processing units) are provided which allow mechanical processing steps on the printing material, for example embossing, trimming (perforation, punching) or turning. Printing presses of that type which can operate by using a plurality of different printing processes are also called combination printing presses or hybrid printing presses.

German Patent DE 103 43 411 B4, corresponding to U.S. Patent Application Publication No. 2006/0156934, discloses a rotary printing press having a flexographic printing unit. Printing forms, so-called plates, are usually attached on the form cylinder of flexographic printing units of that type. During the rolling of the form cylinder on the adjacent cylinders, the edges of the plate cause a so-called gap impact, also called a channel impact, with the pressure between the form cylinder and the adjacent cylinder dropping or rising suddenly. That gap impact can lead in that case to disruptions which can be seen in the printed image.

SUMMARY OF THE INVENTION

It is accordingly an object of the invention to provide a flexographic printing unit with a knee lever system and a narrow web label printing press having at least one flexographic printing unit, which overcome the hereinafore-mentioned disadvantages of the heretofore-known printing units and printing presses of this general type, in which a gap impact and its effects are reduced, in which form cylinders of different diameters can be used and in which form cylinders can be exchanged simply.

With the foregoing and other objects in view there is provided, in accordance with the invention, a printing unit which is configured, in particular, as a flexographic printing unit and includes an engraved roll, a form cylinder and an impression cylinder, the engraved roll making contact with the form cylinder and a press nip being formed between the form cylinder and the impression cylinder, and a printing material being guided. The printing unit is suitable for the use of form cylinders of different diameter. According to the invention, the rotational axes of the engraved roll and the form cylinder are disposed in one horizontal plane independently of the diameter of the form cylinder and the rotational axes of the form cylinder and the impression cylinder are disposed in one vertical plane, with the result that there are in each case diametrical contact points between the cylinders. In this configuration of the cylinders according to the invention, in contrast to configurations which are known from the prior art, oscillations which are introduced by gap impact are transmitted only to a limited extent and relative movements between the cylinders are advantageously limited to a minimum.

In accordance with another advantageous and preferred feature of the printing unit of the invention, the printing unit has at least one knee lever system for applying a prestressing force to the form cylinder. However, two knee lever systems are more preferably provided, in each case one knee lever system for the drive side and one knee lever system for the operator side of the printing unit. The use of at least one knee lever system for applying the prestressing force has a multiplicity of advantages: secure holding of a set position of the knee levers of the knee lever system is possible; knee levers can generate great closing forces; knee levers can very satisfactorily absorb forces which act from the outside, such as a result of gap impact; knee levers can be actuated and regulated very exactly; knee levers have short closing cycles; knee levers can have an inexpensive and compact construction and can therefore be integrated simply into the printing unit; and knee levers are very particularly suitable for linear movements and therefore make satisfactory adaptation of the knee lever system to form cylinders of different diameters possible.

In accordance with a further advantageous feature of the printing unit of the invention, a respective end of the engraved roll and a respective end of the form cylinder are assigned in each case one bearing, and in each case drive-side and operator-side bearings of the engraved roll and the form cylinder are disposed in a common bearing plate. The common mounting of the engraved roll and the form cylinder in a bearing plate makes it possible to decouple the pulses which are produced as a result of gap impact.

In accordance with an added feature of the printing unit of the invention, the printing unit has at least one actuating drive which is assigned to the two bearing plates, for the vertical adaptation of the bearing plates depending on the diameter of the form cylinder. In other words: the bearings of the form cylinder and the engraved roll can be raised together by the at least one actuating drive to such an extent that there is a press nip between the form cylinder and impression cylinder. The above-mentioned right-angled orientation of the cylinders with respect to one another does not change in the process. The force flow which is chosen advantageously due to the cylinder configuration according to the invention, in the case of a gap impact, is therefore independent of the diameter of the form cylinder.

In accordance with an additional feature of the printing unit of the invention, a respective knee lever system has two levers, and a respective lever is connected at its one end to the bearing of the form cylinder and at its other end to an actuator. A prestress is therefore applied by the actuator through the knee levers to the bearing of the form cylinder.

In accordance with yet another feature of the printing unit of the invention, a respective actuator of the knee lever system actuates both levers of the respective knee lever system.

In accordance with yet a further feature of the printing unit of the invention, various variants are conceivable for the configuration of the actuator of the knee lever system: as a pneumatic cylinder, a hydraulic cylinder, a linear motor, a double lift cylinder, etc.

In accordance with yet an added advantageous feature of the printing unit of the invention, measuring elements, in particular strain gages, are provided for pressure force measurement in the bearings of the form cylinder, more precisely: in the bearing shells. As a result of the configuration of the measuring elements both in the drive-side and in the operator-side bearing of the form cylinder, the pressure force can be determined in both bearings independently.

In accordance with yet an additional advantageous feature of the printing unit of the invention, the printing unit is assigned an evaluating and control unit, the latter being connected through data lines to the measuring elements, the at least one actuator and possibly the at least one actuating drive. The evaluating and control unit serves at least to evaluate the measured results of the measuring elements and to actuate the actuators. A value table can be stored in the evaluating and control unit, which value table makes so-called self-teaching of the pressure force setting possible, that is to say automatic setting of the pressure force. To this end, a set point pressure force can be stored in the value table, which set point pressure force is defined depending on the printing plate, tape, plate, substrate, etc.

With the objects of the invention in view, there is concomitantly provided a narrow web label printing press comprising at least one printing unit as described above.

Other features which are considered as characteristic for the invention are set forth in the appended claims, noting that the described invention and the described advantageous developments of the invention also represent advantageous developments of the invention in any desired combination with one another.

Although the invention is illustrated and described herein as embodied in a flexographic printing unit with a knee lever system and a narrow web label printing press having at least one flexographic printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

With regard to further advantages and from a structural and functional perspective of advantageous embodiments of the invention, reference is made to the sub claims and to the description of exemplary embodiments with reference to the appended drawings.

DETAILED DESCRIPTION OF THE INVENTION

Figure 1B:
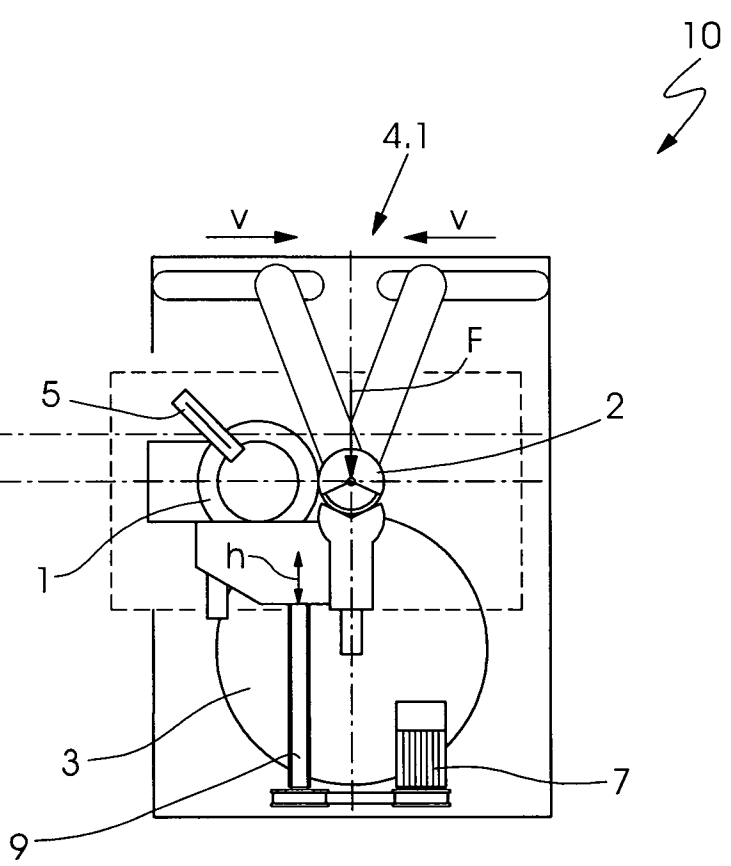
FIG. 1B is a side-elevational view of a printing unit having a relatively small form cylinder.
Figure 1A:
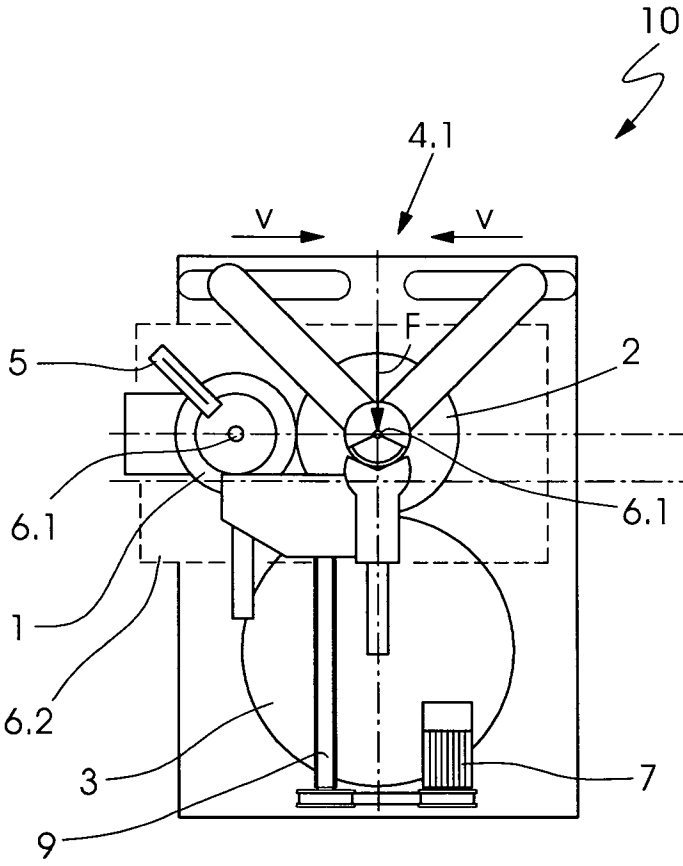
FIG. 1A is a diagrammatic, side-elevational view of a printing unit having a relatively large form cylinder.

Referring now in detail to the figures of the drawings, in which elements and components that correspond to one another are provided with the same designations, and first, particularly, to FIG. 1 thereof, there is seen a printing unit 10 according to the invention which is configured as a flexographic printing unit. The printing unit 10 has a form or plate cylinder 2, an engraved or anilox roll 1 and an impression cylinder 3. A doctor 5 is set against the engraved roll 1. The engraved roll 1 and the form cylinder 2 have bearings 6.1 which are disposed in a common bearing plate 6.2. A knee lever system 4.1 is attached to the bearing 6.1 of the form cylinder 2. That knee lever system 4.1 applies a prestressing force F to the bearing 6.1 and therefore to the form cylinder 2. The bearing plate 6.2 is assigned an actuating drive 7 with a movement of the actuating drive 7 being transmitted through a spindle shaft 9 to the bearing plate 6.2. As a result it is possible to displace the position of the bearing plate 6.2 in the vertical direction in the sense of a reciprocating movement h and thus to adapt the position of the bearing 6.1 of the form cylinder 2 depending on the diameter of the form cylinder 2. Whereas FIG. 1A shows a form cylinder 2 having a relatively large diameter, FIG. 1B shows a form cylinder 2 having a relatively small diameter. Furthermore, in order to form a press nip between the form cylinder 2 and the impression cylinder 3, the bearing plate 6.2 has been lowered by the actuating drive 7 in the direction of the vertical displacement movement h. The knee lever system 4.1 has also been adapted by displacement movements v, with the result that the knee lever system 4.1 continues to act on the bearing 6.1 of the form cylinder 2 and applies the prestressing force F.

An advantageous cylinder configuration (see FIG. 3B) is maintained independently of the diameter of the form cylinder 2 in such a way that the engraved roll 1 and the form cylinder 2 lie in one horizontal plane HE, and the form cylinder 2 and the impression cylinder 3 lie in one vertical plane VE.

Figure 2:
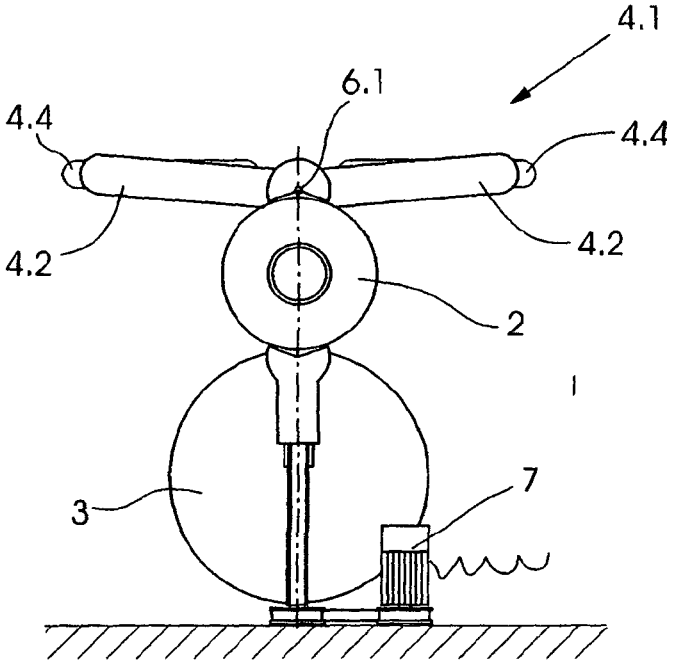
FIG. 2 is a side-elevational view of a knee lever system of a printing unit in a changeover position.
Figure 4A:
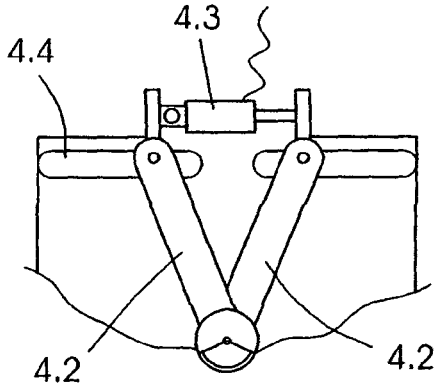
FIG. 4A is a fragmentary, side-elevational view of a first structural variant of the knee lever system.
Figure 4B:
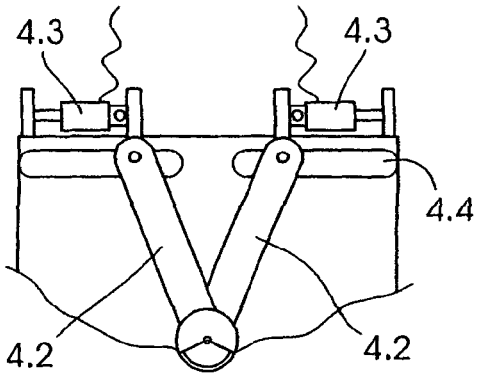
FIG. 4B is a fragmentary, side-elevational view of a second structural variant of the knee lever system.

FIG. 2 shows the construction of the knee lever system 4.1 in greater detail, from which it can be seen that the knee lever system 4.1 has two knee levers 4.2 which are each connected at one respective end thereof to the bearing 6.1 of the form cylinder 2. The other respectively end of each knee lever 4.2 is guided in a respectively guide 4.4. As is seen from FIGS. 4A and 4B, the other end of each knee lever 4.2 is additionally connected to an actuator 4.3. In this case, either an actuator 4.3 which acts on both knee levers 4.2 can be used, as shown in FIG. 4A, or each knee lever 4.2 can be assigned a different respective actuator 4.3, as shown in FIG. 4B. In the illustration of FIG. 2, the bearing 6.1 of the form cylinder 2 has been raised up by the knee levers 4.2 to such an extent that the form cylinder 2 can be removed from the printing unit 10 and a changeover of the printing unit 10 is thus made possible.

Figure 3A:
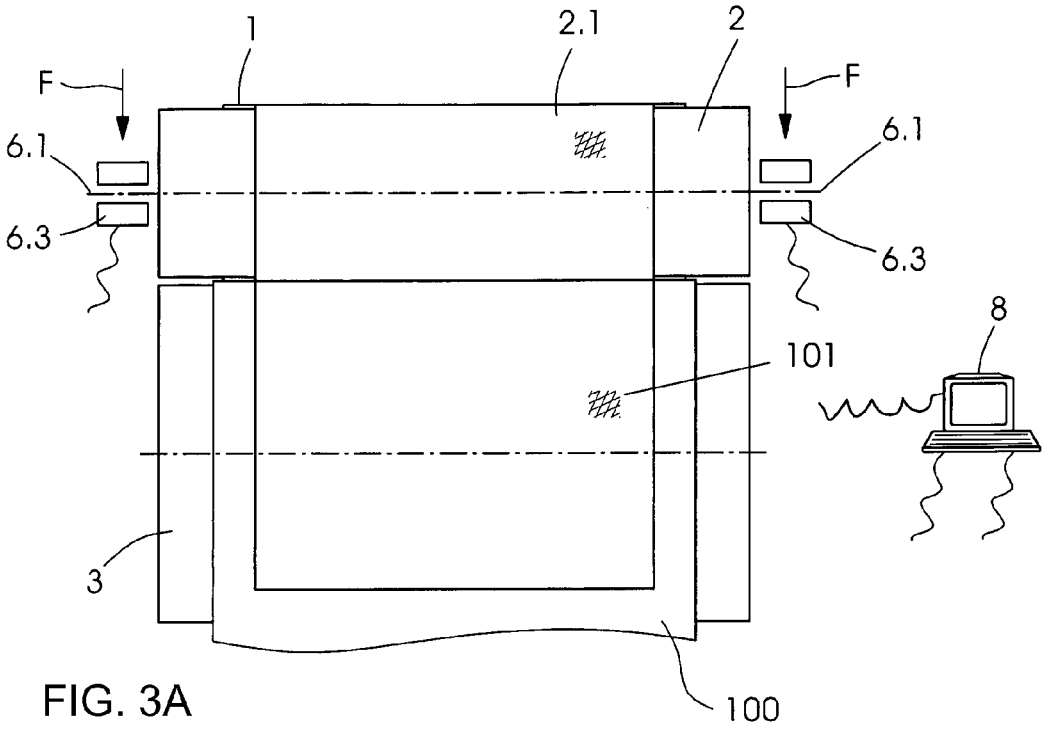
FIG. 3A is a plan view of cylinders of the printing unit.

FIG. 3A shows the configuration of the cylinders 1, 2, 3 of the printing unit 10. For the sake of improved clarity, the knee lever system 4.1 has been omitted. Ink is transferred from the engraved roll 1, which can be seen only slightly in the background, to a plate 2.1 which is attached on the form cylinder 2. A printing material web 100 is guided in the press nip between the form cylinder 2 and the impression cylinder 3 and a printed image 101 is applied onto the printing material web 100 by the plate 2.1. Measuring elements 6.3 which can be configured, for example, as strain gages, are disposed in the bearings 6.1 of the form cylinder 2. The measuring elements 6.3 are connected to an evaluating and control unit 8. The actuators 4.3 of the knee lever system 4.1 and optionally the actuating drive 7 are likewise connected to the evaluating and control unit 8 and can be actuated by the evaluating and control unit 8.

Figure 3B:
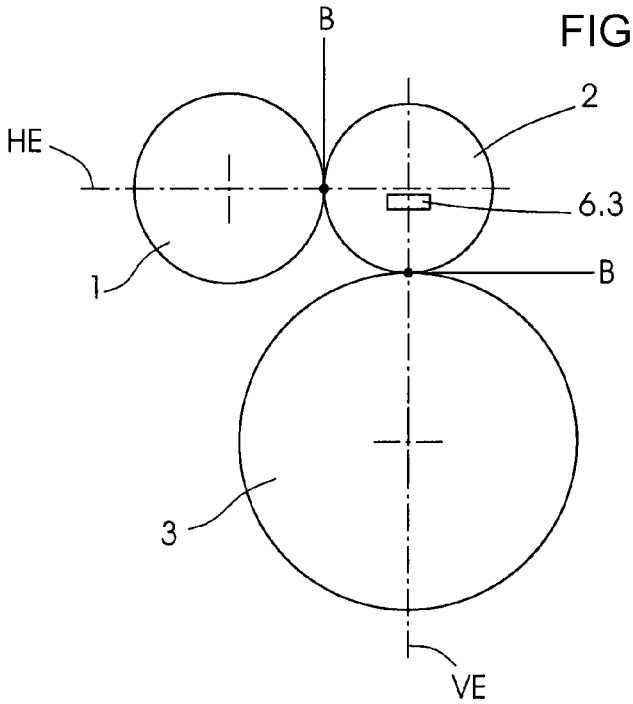
FIG. 3B is an end view of the cylinders of the printing unit.

The configuration according to the invention of the cylinders 1, 2, 3 results from the view in FIG. 3B. The engraved roll 1 and the form cylinder 2 are disposed in such a way that their rotational axes are situated in one horizontal plane HE. The form cylinder 2 and the impression cylinder 3 are disposed in such a way that their rotational axes are situated in one vertical plane VE. The result of this configuration is that there is a diametrical contact point B between the engraved roll 1 and the form cylinder 2 and there is likewise a diametrical contact point B between the form cylinder 2 and the impression cylinder 3.

The invention claimed is:

1. A flexographic printing unit, comprising:
- an engraved roll having a rotational axis;
- an impression cylinder having a rotational axis; and
- a form cylinder having a rotational axis, said form cylinder being one of a group of form cylinders having different diameters;
- said rotational axes of said engraved roll and said form cylinder disposed in one horizontal plane independently of said diameter of said form cylinder;
- said rotational axes of said form cylinder and said impression cylinder disposed in one vertical plane independently of said diameter of said form cylinder;
- an operator-side bearing plate and a drive-side bearing plate;
- said engraved roll and said form cylinder each having a respective operator-side bearing disposed in common in said operator-side bearing plate; and
- said engraved roll and said form cylinder each having a respective drive-side bearing disposed in common in said drive-side bearing plate.

2. The flexographic printing unit according to claim 1, which further comprises at least one knee lever system configured to apply a prestressing force to said form cylinder.

3. The flexographic printing unit according to claim 1, which further comprises at least one actuating drive configured to vertically adapt said bearing plates in dependence on said diameter of said form cylinder.

4. The flexographic printing unit according to claim 1, which further comprises an actuator, and a knee lever system having two levers, each of said levers have one end connected to one of said bearings of said form cylinder and another end connected to said actuator.

5. The flexographic printing unit according to claim 4, wherein said actuator is configured as a pneumatic cylinder, a hydraulic cylinder, a linear motor or double lift cylinder.

6. The flexographic printing unit according to claim 4, which further comprises measuring elements configured to provide pressure force measurement in said bearings of said form cylinder, and an evaluating and control unit configured to evaluate measured results of said measuring elements and to actuate said actuator.

7. The flexographic printing unit according to claim 1, which further comprises two actuators, and a knee lever system having two levers, each of said levers have one end connected to one of said bearings of said form cylinder and another end connected to a respective one of said actuators.

8. The flexographic printing unit according to claim 7, wherein said actuators are each configured as a pneumatic cylinder, a hydraulic cylinder, a linear motor or double lift cylinder.

9. The flexographic printing unit according to claim 7, which further comprises measuring elements configured to provide pressure force measurement in said bearings of said form cylinder, and an evaluating and control unit configured to evaluate measured results of said measuring elements and to actuate said actuators.

10. The flexographic printing unit according to claim 1, which further comprises measuring elements configured to provide pressure force measurement in said bearings of said form cylinder.

11. The flexographic printing unit according to claim 10, wherein said measuring elements are strain gages.

12. A narrow web label printing press, comprising:
- at least one flexographic printing unit according to claim 1.

13. A method for assembling a flexographic printing unit, the method comprising the following steps:
- providing an engraved roll having a rotational axis;
- providing an impression cylinder having a rotational axis;
- selecting a form cylinder having a rotational axis from a group of form cylinders having different diameters;
- placing the rotational axes of the engraved roll and any one of the form cylinders having different diameters in one horizontal plane independently of the diameter of the one selected form cylinder;
- placing the rotational axes of the one selected form cylinder and the impression cylinder in one vertical plane independently of the diameter of the one selected form cylinder;
- providing an operator-side bearing plate and a drive-side bearing plate;
- providing each of the engraved roll and the form cylinder with a respective operator-side bearing disposed in common in the operator-side bearing plate; and
- providing each of the engraved roll and the form cylinder with a respective drive-side bearing disposed in common in the drive-side bearing plate.

* * * * *